United States Patent [19]

Garner et al.

[11] Patent Number: 4,913,584

[45] Date of Patent: Apr. 3, 1990

[54] CONCRETE SCREEDING MACHINE

[76] Inventors: James D. Garner, 2704 Boars Heads Rd.; John M. Hinnant, 3973 Belair Rd., both of Augusta, Ga. 30907

[21] Appl. No.: 356,260

[22] Filed: May 24, 1989

[51] Int. Cl.[4] ..... E01C 19/29

[52] U.S. Cl. ..... 404/123; 404/126

[58] Field of Search ..... 404/103, 106, 119, 120, 404/122, 123, 128; 425/63, 356

[56] References Cited

U.S. PATENT DOCUMENTS

| | | | |
|---|---|---|---|
| 1,017,430 | 2/1912 | Lilleberg | 404/123 |
| 1,584,385 | 5/1926 | Lichtenberg | 404/119 |
| 2,048,071 | 7/1936 | Jacobson | 404/106 |
| 2,127,485 | 8/1938 | Owens et al. | 404/123 |
| 2,426,702 | 9/1947 | Millikin | 404/119 |
| 2,687,679 | 5/1952 | Clary | 404/123 |
| 3,377,933 | 4/1968 | Dale | 404/98 |
| 4,115,976 | 9/1978 | Rohrer | 52/741 |
| 4,157,877 | 6/1979 | Lee | 404/128 |
| 4,747,726 | 5/1988 | Garner et al. | 404/123 |

*Primary Examiner*—Jerome W. Massie
*Assistant Examiner*—Matthew Smith
*Attorney, Agent, or Firm*—Thomas & Kennedy

[57] ABSTRACT

A screeding machine has mounted thereon, in a trailing position, a finishing roller 51 which is driven at a rotational speed sufficient to impart a polish or patina to the surface of the paving material.

10 Claims, 2 Drawing Sheets

CONCRETE SCREEDING MACHINE

FIELD OF THE INVENTION

This invention relates to machines for screeding materials such as concrete and cement used for paving roads and the like.

BACKGROUND OF THE INVENTION

Numerous types of machines for screeding paving materials such as concrete have been developed, examples of which are shown in U.S. Pat. Nos. 1,584,385; 2,426,702; 2,687,679; 3,377,933; 4,115,976; and 4,747,726. Such machines generally comprise a frame supported by two or more rollers, at least one of which is driven, that roll on forms straddling the surface area to be paved which serve as a track or support rails for the machine. A screed roller is located forward on the frame which is slightly elevated above the support rollers and the forms. The screed roller is generally driven in a reverse direction to the support rollers so that as the machine advances through the paving material, which has been clumped between the forms, the screed roller flings and spreads the material ahead of the machine, flattening and leveling piles thereof. The support rollers then pass over the material, further flattening and smoothing it.

The screeding process as just described produces a fairly flat, even surface of paving material. However, as is often the case, where a smooth, essentially non-porous or non-pitted surface is desired, it is necessary that the operation be completed manually by means of work crews using bull floats or trowels. Immediately after screeding, the paving material, especially concrete, contains a great deal of semi-liquid "soup". Floating or troweling causes this soup to rise to the surface where it is evenly spread thus producing a smooth, relatively non-pitted surface. Such floating or troweling, while desirable for producing a smooth surface, is both time consuming and labor intensive, thus costly.

Accordingly, it is an object of the present invention to reduce materially the time and expense incident of the finish float operation.

More particularly, it is an object of the present invention to incorporate the final smoothing operation into the operation of the screeding machine, thereby substantially eliminating the labor intensive, costly floating operation.

SUMMARY OF THE INVENTION

The invention, in a preferred embodiment thereof, comprises an attachment for mounting on the rear portion of a screeding machine such as, for example, the machine shown in U.S. Pat. No. 4,747,726 of Garner and Hinnant, the present applicants. The attachment comprises a pair of support arms extending from the rear of the machine and pivotably mounted thereto. A finishing roller, of smaller diameter than the screeding roller and the support rollers, is rotationally mounted to the support arms and extends between them across the rear of the machine, transverse to the direction of travel thereof. A driving means is mounted to one of the support arms and is coupled to one end of the finish roller by suitable gearing or sprocket chain to rotate the roller.

Means for raising and lowering the support arms, and hence the finishing roller, comprises a pair of arms, one on each side of the machine and mounted thereto at one arm end. The free end of each arm has a cylinder and piston assembly pivotably mounted at the rear end of the machine. The end of each piston remote from the cylinder is pivotably mounted to the corresponding support arm. Thus the finishing roller can be lowered into contact with the paving material or elevated to position out of contact therewith by actuation of the cylinder and piston assembly.

A motor drives the finishing roller at higher revolutions per minute than the other rollers are driven so that the roller actually slips on the surface of the paving material as the screeding machine is operated. This action causes the soupy material discussed hereinbefore to rise to the top of the paving material where it is uniformly spread by the finishing roller into an almost polished finish.

DETAILED DESCRIPTION

Figure 1:
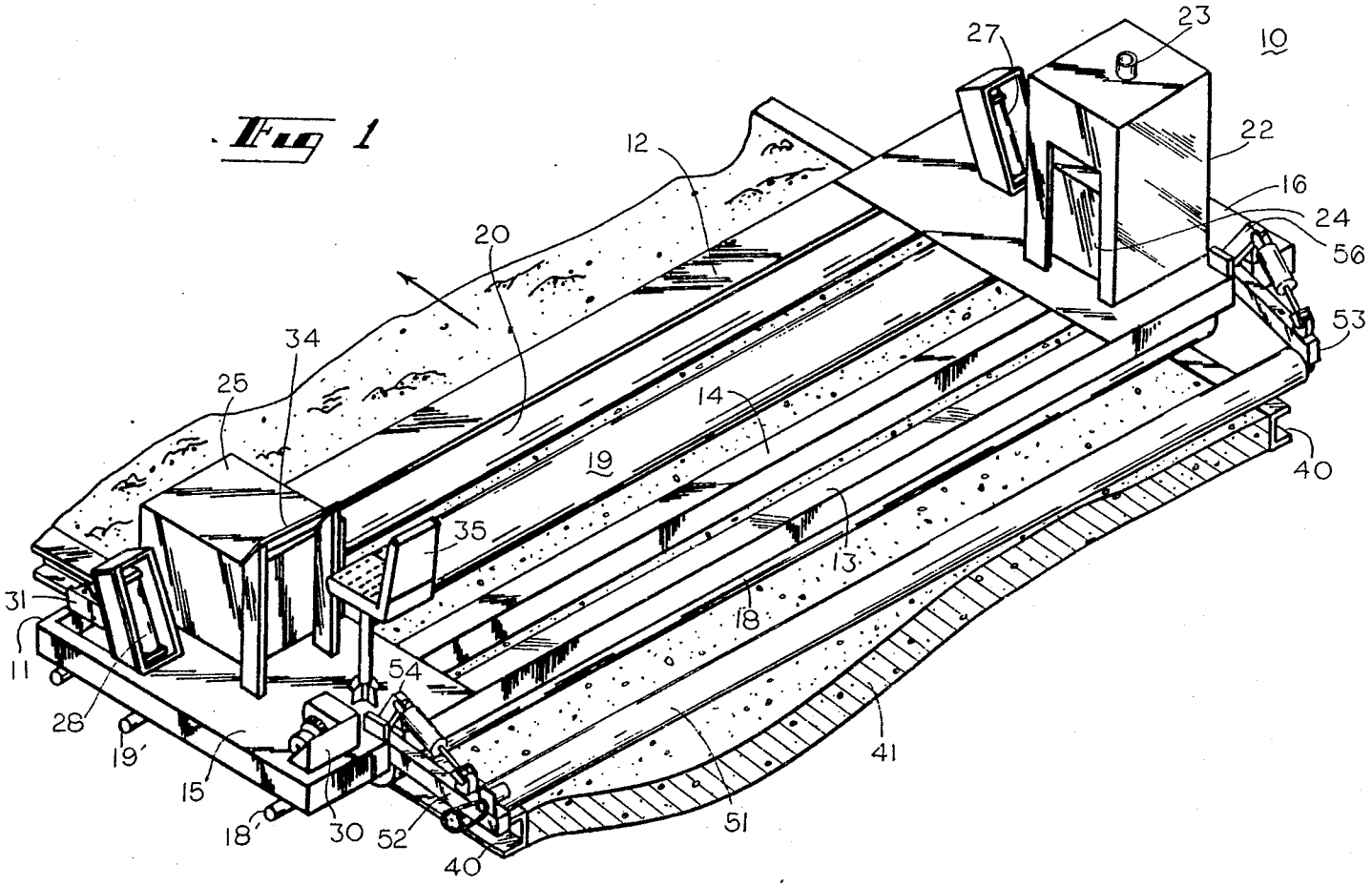
FIG. 1 is a perspective view of a screeding machine which embodies principles of the present invention and which is shown operating on paving material of a road being paved.

With reference to FIG. 1, there is depicted a self-propelled screeding machine 10, such as that shown in U.S. Pat. No. 4,747,726, which has a frame that includes a front beam 11 disposed beneath a walkway 12, a rear beam 13 and an intermediate beam 14 all of which span the space between and provide support for two side platforms 15 and 16. Rotatably mounted on the frame and spanning a major portion of the width of the machine are a rear drive roller 18, a forward drive roller 19, and a screed roller 20 located ahead of forward roller 19.

The machine 10 is provided with a hydraulic power system that includes a diesel engine within a housing 22 from which an exhaust stack 23 extends, and a master pump mounted within a pump housing 24 atop the platform 16. The hydraulic system includes an hydraulic oil reservoir 25 which is mounted upon the other platform 15. The loads powered by the hydraulic power system include a right side hydraulic lift cylinder 27 and a left side hydraulic lift cylinder 28, each of which is mounted within a protective housing 29. Additional system loads include a hydraulic motor 30 mounted on a rear portion of platform 15 for driving the drive roller 18, and a hydraulic motor 31 mounted on a forward portion of platform 15 for driving the screed roller 20. The hydraulic system is of conventional construction and thus its hydraulic lines and controls have not, for clarity, been shown. It is to be understood that these lines extend to and between the several elements of the system, including the loads, with those extending between system components mounted on the two platforms 15 and 16 passing through the beam 14, which protects them from possible damage during operation. The entire system is controlled from a control panel 34 which is positioned behind the reservoir 25 in front of a chair 35 upon which the operator may sit while operating the machine.

The rear drive roller 18 and the forward drive roller 19 are driven synchronously by power takeoff from hydraulic motor 30. This power takeoff includes a drive chain 37 that is routed downwardly from the motor through an opening in the platform 15 and about a sprocket mounted to a portion of the axle 18' that extends outwardly from an end of drive roller 18. The axle 18' is in turn coupled with the axle 19' of drive roller 19 by a chain, not shown, that is routed over sprockets mounted to the two axles, 18' and 19'. Thus by operation of the hydraulic motor 30, the drive rollers 18 and 19 can be rotated in the counterclockwise direction indicated by the arrows shown in FIG. 2 adjacent these two rollers in advancing the machine.

Figure 2:
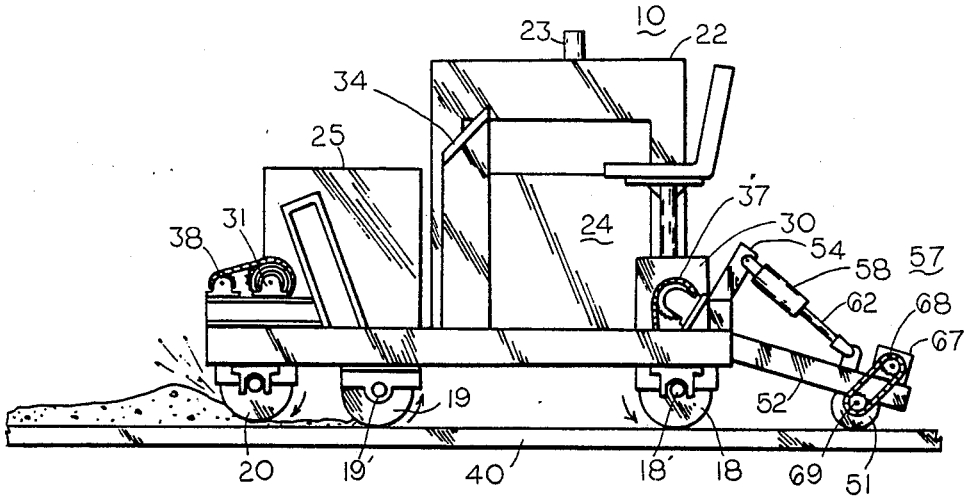
FIG. 2 is a side elevation view of the machine of FIG. 1 further illustrating the present invention.

The screed roller 20 is driven by the motor 31 with power transmitted from the motor to it by an endless chain 38 that is partially shown in FIG. 2. This chain 38 is also routed over a sprocket mounted to the axle of the screed roller 20 so as to drive the screed roller in a clockwise direction as shown in FIG. 2. The screed roller is mounted at a height such that it is elevated slightly above the rollers 18 and 19, so that it rotates slightly above an imaginary reference support plane extending tangentially to the lowermost points of the drive rollers 18 and 19. This imaginary plane also extends across the tops of the two C channel shaped forms 40 that straddle the road being paved.

The screeding machine as thus far described is the same as that shown in U.S. Pat. No. 4,747,726, and, as such, is equipped with a steering mechanism for steering the machine as it advances along the forms 40 in leveling and finishing the concrete surface of a roadway being paved between the two forms. The steering mechanism includes lift cylinders 27 and 28 which, as explained in detail in the aforementioned patent, impart steerability of the screeding machine by altering the elevation of one or the other end of drive roller 19.

As pointed out hereinbefore, the screeding machine as thus far described can produce a smooth, even concrete roadway surface. However, the surface may contain irregularities and pits, and be somewhat porous. Thus it can be more desirable to produce a hard, polished, essentially non-porous or non-pitted surface. To this end machine 10 is equipped with a finishing roller assembly which comprises a finishing roller 51 of approximately the same length as drive rollers 18 and 19, and of approximately one-half the of those rollers. Roller 51 extends between and is supported by support arms 52 and 53 which are pivotably mounted to platforms 15 and 16 respectively, so as to extend toward the rear, as shown. Also mounted on platform 15 and 16, and affixed thereto at one end, are a pair of arms 54 and 56 which extend upwardly and to the rear, as shown.

Figure 3:
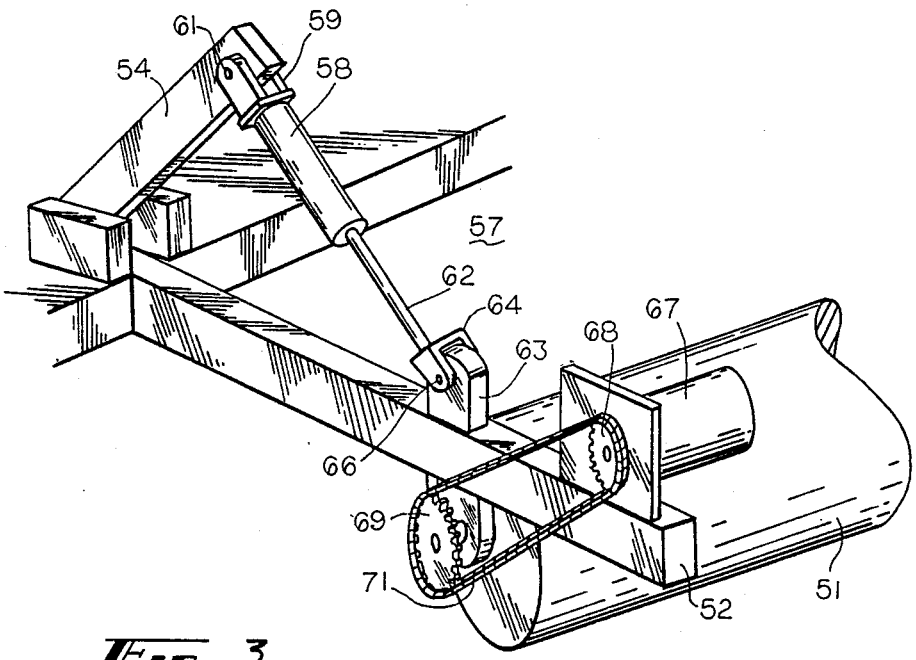
FIG. 3 is a perspective partial view of details of the present invention.

The mechanism whereby roller 51 may be lowered into contact with the road or surface being paved is best seen in FIG. 3, which shows only the specified mechanism for raising and lowering support arm 52. It is to be understood that the corresponding mechanism for raising and lowering arm 53 is the same as that for the arm 52. The elevating and lowering mechanism comprises a hydraulic cylinder and piston assembly 57 in which one end of cylinder 58 is pivotably mounted to the free end of arm 54 by means of a clevis or fork 59 and a pin 61. The remote end of piston rod 62 is pivotably mounted on a pillow block 63 affixed to support arm 52 by means of another clevis or fork 64 and pin 66. Assembly 57, which is a part of the hydraulic system, previously discussed, is under the control of the operator. When it is desired to raise the finishing roller 51, the piston and hence rod 62, as well as the corresponding piston and rod on platform 16, moves into cylinder 58 thereby raising pivoted arm 52 and the roller. When the finishing roller 51 is to be lowered into contact with the road or surface being paved, in light, slipping contact with the forms, the piston and rod 62 are forced outwardly, thereby lengthening the span of assembly 57 and lowering pivoted arm 52 and roller 51.

Roller 51 is rotatably driven by means of another hydraulic motor 67 mounted on arm 52, as best seen in FIG. 3, which is coupled to roller 51 by means of a sprocket 68 on the motor shaft and a sprocket 69 on the axle of roller 51, which are coupled by an endless chain 71. The ratios of the sprocket diameters and the motor speed are such that roller 51 rotates at approximately one and one-third to two times the speed of screed roller 20 but in the opposite rotary direction thereto. Typical values of the rpms of roller 20 and roller 51 are 82 rpm and 112 rpm, respectively, both of which are faster than the rpm of the drive rollers 18 and 19. Roller 51 is approximately one-half the diameter of the drive rollers 18 and 19 and of the screed roller 20. Its speed can be varied relative to the other rollers by a change in the ratio of the diameters of sprockets 68 and 69, or by varying the speed of motor 67.

In operation, the machine may be advanced upon irregular piles of concrete which have been dumped between forms 40, 40, as best seen in FIGS. 1 and 2, whereupon screeding of the concrete takes place. As can be seen, the screeding roller 20 flings forward and spreads out the wet concrete paving material leaving only a small layer of material in advance of the forward drive roller 19. The drive rollers 18 and 19 pass over this layer and flatten it to the desired level, leaving an even concrete surface suitable as a roadway surface. It is at this point in the operation that, with prior art techniques, a crew of workmen with floats has imparted the final finish to the concrete surface. With the present invention, however, the drive roller 18 is followed by the finishing roller 51, which has been lowered into contact with the concrete surface by the operator. Roller 51 revolves at such a speed that there is a slight slippage of the roller on the surface, which speeds up the rise of the soupy material to the top, and which spreads and, in effect, polishes the material. The net result is a surface, when dry, of smooth finish with a minimum of pits and pores. When the concrete is poured, air in the form of bubbles and pockets is trapped in the mass. An even finer surface can be achieved with elimination of the air from the concrete with agitators mounted to the machine forwardly of the screed roller, the finishing roller then leaving an extremely smooth surface.

From the foregoing it is seen that the just described embodiment of the invention in combination with a screeding machine produces an improved surface of paving material. It is to be understood that the foregoing description is illustrative of the principles of the invention in a preferred form thereof and that numerous modifications, additions, or deletions may be made to the structure without departure from the spirit and scope of the invention.

We claim:

1. A screeding machine comprising, in combination, a frame, first and second drive rollers mounted to said frame for rotation in one rotary direction about axes parallel to a reference support plane and tangentially to the reference support plane; means for driving at least one of said drive rollers in said one rotary direction; a screed roller mounted to a forward portion of said frame for rotation above said reference support plane; means for driving said screed roller in a rotary direction opposite to said one rotary direction; a finishing roller mounted to a rear portion of said frame and extending across the rear of said machine transverse to the direction of travel thereof with its axis substantially parallel to said reference plane; and means for driving said finishing roller at a rotational speed different from the speed of rotation of said screed roller.

2. A screeding machine as claimed in claim 1 wherein the diameter of said finishing roller is substantially one-half the diameter of said first or second roller.

3. A screeding machine as claimed in claim 1 wherein said finishing roller drive means includes means for driving said finishing roller at a speed of between one and one-third to two times the rotational speed of said screed roller.

4. A screeding machine as claimed in claim 1 and further including means for lowering said finishing roller into tangential contact with said reference plane, and for raising said finishing roller out of contact with said reference plane.

5. A screeding machine as claimed in claim 4 wherein said frame has a first side and a second side, and wherein said means for lowering said finishing roller comprises a first support arm pivotably mounted to said frame at said first side thereof and a second support arm pivotably mounted to said frame at said second side thereof, said finishing roller extending between and rotatably supported by said support arms, and means pivotably connected to said arms and to said frame for raising and lowering said support arms.

6. A screeding machine as claimed in claim 5, wherein said means for raising and lowering said support arms comprises a hydraulic cylinder and piston assembly pivotably connected between said first support arm and said frame and a hydraulic cylinder and piston assembly pivotably connected between said second support arm and said frame.

7. For use with a concrete screeding machine having first and second drive rollers and a screed roller mounted on a forward portion of the machine, means for driving at least one of the drive rollers and means for driving the screed roller, a finishing roller assembly comprising first and second spaced supports adapted to be pivotably mounted to the machine, a finishing roller extending between and rotatably supported by said support arms, and drive means mounted to one of said support arms and coupled to said finishing roller at one end thereof.

8. A finishing roller assembly as claimed in claim 7 wherein the diameter of said finishing roller is approximately one-half the diameter of said first and second rollers.

9. A finishing roller assembly as claimed in claim 7 further including means for raising and lowering said support arms with respect to the screeding machine.

10. A finishing roller assembly as claimed in claim 9 wherein said means for raising and lowering comprises at least one hydraulic cylinder and piston assembly having one end pivotably connected to said support arms and having its other end adapted to be pivotably mounted to said frame.

* * * * *